United States Patent [19]

Ramaswamy

[11] Patent Number: 5,043,030

[45] Date of Patent: Aug. 27, 1991

[54] STAB INITIATOR

[75] Inventor: Coodly P. Ramaswamy, Christiana, Pa.

[73] Assignee: Breed Automotive Technology, Inc., Boonton Township, Morris County, N.J.

[21] Appl. No.: 593,121

[22] Filed: Oct. 5, 1990

[51] Int. Cl.[5] ..... C06B 45/16

[52] U.S. Cl. ..... 149/16; 102/202.5; 149/20; 149/27; 149/28; 149/15; 149/61

[58] Field of Search ..... 149/16, 26, 27, 28, 149/15, 61; 102/202.5

[56] References Cited

U.S. PATENT DOCUMENTS 4,388,126 6/1983 Johnson et al. ..... 179/15

4,831,932 5/1989 Bayerkohler et al. ..... 102/202.5

*Primary Examiner*—Stephen J. Lechert, Jr.

*Attorney, Agent, or Firm*—Kane Dalsimer Sullivan Kurucz Levy Eisele and Richard

[57] ABSTRACT

The invention is directed to a primer/detonator acceptable for use in an automobile air bag system.

5 Claims, 1 Drawing Sheet

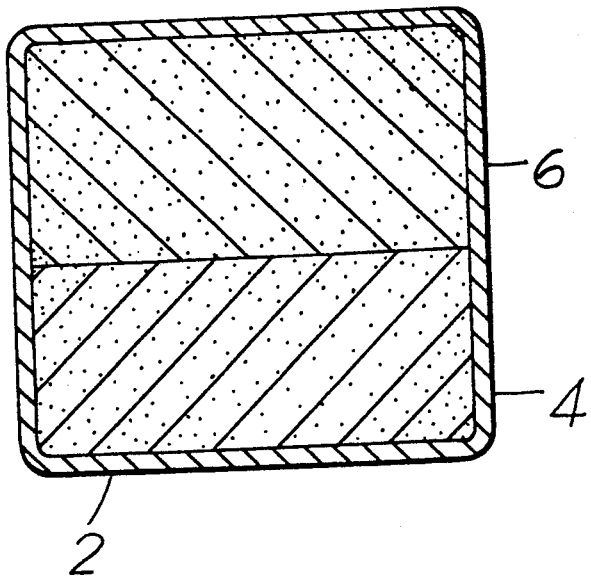
6
4
2

STAB INITIATOR

FIELD OF INVENTION

The invention is directed to a primer/detonator acceptable for use in an automobile air bag system.

BACKGROUND OF THE INVENTION

Primers (a/k/a detonators) are the means used to detonate an explosive charge. These devices consist of a primary explosive component initiated by stab (i.e.—friction) or impact, an intermediate explosive composition which is set off by the primer composition, and a base charge of secondary explosive such as RDX or HMX to provide the desired explosive output. These primers are ordinarily coupled with booster charges and a propellant to form an explodable ignition chain.

One of the common low input energy primers/detonators is an M55 Detonator, which is extensively used in ordnance for anti-personnel and anti-vehicular munition systems. The make up of this detonator consists of:

(a) A primary explosive composition containing basic lead styphnate, dextrinated lead azide, antimony sulfide, barium nitrate, and tetracene;

(b) An intermediate explosive charge of RD 1333 lead azide; and (c) RDX as secondary explosive.

The M55 detonator is set off by stab action and shows a sensitivity of about 0.80 inch-oz at 99.99% reliability and 95% confidence level. In this detonator system, while basic lead styphnate and dextrinated lead azide serve as the main primary explosives, barium nitrate serves as a supplier of oxygen to the system and the antimony sulfide serves as a fuel and mechanical sensitizer because of its high melting point. But it is tetracene that plays a unique and important role. It is a chemical sensitizer possessing properties which makes the system function at an input sensitivity or energy below Primer/detonator systems are employed in a variety of applications. Some of the more obvious applications are in weapon systems, razing buildings, and in creating excavations. However, such charges are also utilized in not so obvious applications such as automobile airbag systems. Explosive charges are uniquely suited for these systems because the explosions instantaneously generate a large volume of gas which fills the airbag. It is absolutely necessary that the airbags be filled instantaneously, as the time between an automobile crash and the passenger's impact with the windshield or dashboard is no more than a fraction of a second.

A typical explosive charge utilized in an airbag system is comprised of a primer/detonator (discussed below), a booster charge consisting of boron and potassium nitrate, and a propellant containing sodium azide, such as that disclosed in U.S. Pat. No. 3,947,300.

Since the function of the primer/detonator is to initiate the explosive reaction, the primer must possess some means of commencing the ignition of the chain. This means is known as the sensitizer, which may take either a chemical or mechanical form. As indicated above, one of the best chemical sensitizers is tetracene because of its excellent input sensitivities.

When the M55 primer is detonated, it sends off shock waves which while igniting the intermediate charge, shatters the cup containing the intermediate charge, resulting in unreliable ignition of the propellant charge. Therefore, it would be advantageous to provide a primer/detonator which may be used to ignite an airbag system which does not generate shock waves for igniting the system.

SUMMARY OF THE INVENTION

It is an object of the invention to provide a primer utilizing a mechanical sensitizer which possesses a high degree of sensitivity to a low energy stab or impact. That is to say, a sensitivity of one inch-oz or less.

It is further objected to provide a primer/detonator that upon firing does not emit shock waves.

In the present invention the primer is composed of two stages designated as the primary end and the output end. The primary end is an NOL #130 primer mixture and is composed of basic lead styphnate, barium nitrate, antimony sulfide, lead azide and tetracene. The output end is a modified NOL #60 primer mixture composed of basic lead styphnate, barium nitrate, and antimony sulphide. When the primer is impacted ignition propagates through the primary end into the output end. By using this two composition approach, the intermediate charge is ignited by a hot flame containing particle debris that emanates from the primer. No shock waves emanate from the primer.

BRIEF DESCRIPTION OF THE DRAWINGS

FIG. 1 is a diagram showing the primer/detonator of the present invention.

DETAILED DESCRIPTION OF THE PREFERRED EMBODIMENT

The primary end is a 15 mg± 0.5 mg NOL #130 primer mixture comprised as follows:

| Component | % Composition |
|---|---|
| Basic Lead Styphnate | 40 ± 2% |
| Barium Nitrate | 20 ± 2% |
| Antimony Sulfide | 15 ± 1.5% |
| Lead Azide RD 1333 | 20 ± 2% |
| Tetracene | 5 ± 5% |

the mixture is compressed at 70,000 psi.

The output end is a 70 mg± 3 NOL #60 primer mixture comprised as follows:

| | |
|---|---|
| Basic Lead Styphnate | 63 ± 2% |
| Barium Nitrate | 26 ± 2% |
| Antimony Sulphide | 11 ± 1.5% |

As can be seen in FIG. 1, the primary end 2 and the output end 4 are adjoined and contained within an initiator cup 6. The initiator cup can be composed of any suitable material. The joints of the cup are sealed and then coated with varnish. The varnish is moisture proof MIL-V-16399A (OS) 16 Sept. 1971 Type B. Or in the alternative, a silicon varnish such as that available from Dow & Corning, 1-2577 silicone based, conformal coating. This varnish provides temperature and humidity protection up to 95% relative humidity and 85° C.

The primer disclosed herein has a sensitivity of less than 1 inch-oz, with a 95% single sided confidence and a 99.99% reliability.

What is claimed is:

1. A primer comprised of adjoining compositions of NOL #130 primer mixture and NOL #60 primer mixture, wherein the NOL #130 primer mixture is comprised of:

Basic Lead Styphnate;
Barium Nitrate;
Antimony Sulfide;
Lead Azide RD 1333;
Tetracene;

and the NOL #60 pl primer mixture is comprised of:

Basic Lead Styphnate;
Barium Nitrate; and
Antimony Sulfide.

2. A primer as set forth in claim 1 wherein the NOL #130 primer mixture is comprised of the following components in the following percentages:

Basic Lead Styphnate: 40±2%
Barium Nitrate: 20±2%
Antimony Sulfide: 15±1.5%
Lead Azide RD 1333: 20±2%
Tetracene: 5±0.5% and the NOL #60 primer mixture is comprised of the following components in the following percentages:

Basic Lead Styphnate: 63≈2%
Barium Nitrate: 26±2%
Antimony Sulfide: 11±1.5%

3. The primer as set forth in claim 2 wherein the mass of the NOL #130 primer mixture is 15 mg±0.5 mg and the mass of the NOL primer mixture is 70 mg±3.5 mg.

4. The primer as set forth in claim 3 wherein the NOL #130 primer mixture and the NOL #60 primer mixture are adjoined and contained within an initiator cup.

5. The primer as set forth in claim 4 wherein the initiator cup is coated with varnish.

* * * * *